US005548877A

United States Patent [19]

Nitsche

[11] Patent Number: 5,548,877

[45] Date of Patent: Aug. 27, 1996

[54] ROTARY LOCK FOR RELEASABLY CONNECTING CORNER FITTINGS OF CONTAINERS STACKED ONE UPON THE OTHER

[75] Inventor: Torsten M. Nitsche, Langemarckstr. 226-228, D28199 Bremen, Germany

[73] Assignee: Torsten M. Nitsche, Bremen, Germany

[21] Appl. No.: 387,138

[22] Filed: Feb. 10, 1995

[30] Foreign Application Priority Data

Feb. 11, 1994 [DE] Germany ..... 44 04 392.9

[51] Int. Cl.[6] ..... B65D 21/02

[52] U.S. Cl. ..... 24/287; 24/595

[58] Field of Search ..... 24/287, 590–595, 24/597; 410/82, 83, 95

[56] References Cited

U.S. PATENT DOCUMENTS

| | | | |
|---|---|---|---|
| 3,456,967 | 7/1969 | Tantlinger et al. | 24/287 |
| 4,082,052 | 4/1978 | Looks . | |
| 4,782,561 | 11/1988 | Hayama . | |

FOREIGN PATENT DOCUMENTS

| | | | |
|---|---|---|---|
| 2546876 | 4/1977 | Germany | 410/82 |
| 2632530 | 1/1978 | Germany . | |
| 2840281 | 3/1979 | Germany . | |
| 8402894 U | 4/1984 | Germany . | |
| 3538892 | 5/1986 | Germany | 410/82 |
| 3642399 | 6/1988 | Germany . | |
| 3710419 | 10/1988 | Germany . | |
| 3809834 | 12/1991 | Germany . | |
| WO92/13783 | 8/1992 | WIPO . | |

*Primary Examiner*—James R. Brittain
*Attorney, Agent, or Firm*—Hill, Steadman & Simpson

[57] ABSTRACT

A rotary lock has a shank with a latch at each end mounted to be rotated in a housing. The latch has three positions with a basic position with both latches in a locking position being disposed between the other two positions in which one latch is locked and the other latch is unlocked. The lock includes a handle connected to the shank to move the lock from the basis position to the other two positions against a force of a single spring which biases the latches and shank back toward the basis position.

24 Claims, 4 Drawing Sheets

ROTARY LOCK FOR RELEASABLY CONNECTING CORNER FITTINGS OF CONTAINERS STACKED ONE UPON THE OTHER

BACKGROUND OF THE INVENTION

1. Field of the Invention

The invention relates to a rotary lock comprising a locking pin axially rotatable in a housing and comprising a shank, at each end of which a transverse latch is secured, and which pin is subject to the action of a hand lever, the rotary lock being adapted to be brought basically into three positions relatively to a corner fitting of a container for the purpose of releasably connecting two containers one upon the other. The three positions are the locking position of one first transverse latch with the other or second transverse latch in an unlocked position; the second latch in a locked position with the first latch unlocked; and with both latches in a locked position.

Rotary locks of this kind are used particularly to secure containers stacked one upon the other from slipping relatively to one another during transportation, as on a ship, in a truck or by rail. For this purpose, a container has at each corner a fitting into each of which a transverse latch can be introduced through a slot in order to be brought into a locking position to engage beneath the associated corner fitting. The second transverse latch of the rotary lock is then introduced into a corner fitting of an adjacent container disposed either above or beneath the same and locked correspondingly. Locking and unlocking are preferably effected during loading on to and unloading from the corresponding means of transport.

2. Prior Art

A rotary lock is already known from DE 36 42 399 A1, wherein to couple two containers the following three positions are traversed successively: a prelocking starting position, in which the top transverse latch is in an open position for engagement in a corner fitting of the top container, a prelocking middle position in which the bottom transverse latch is in an opened position, while the top transverse latch is pre-locked, and an end locking position in which both transverse latches are locked. For locking purposes, the rotary lock is first introduced by its top transverse latch into the slot of the bottom corner fitting of the top container, whereupon the hand lever is pivoted to produce the prelocking middle position. The top container with the rotary lock which has the bottom transverse latch of which in the prelocked position is in the unlocked position, is then placed on the bottom container. A force storage means, which comprises at least one spring, is actuated by an actuating member which, when the two containers are driven together, is pressed into the rotary lock housing and thus prestresses the force storage means until the bottom transverse latch in its unlocked position is mounted or inserted in the corner fitting of the bottom container and then, by at least partial expansion of the force storage means, passes automatically into its locked position. A return means is also connected to the actuating member and by means of at least one other spring actuates the actuating member to effect unlocking when the hand lever is moved accordingly. Unfortunately, at least one additional spring is provided for temporarily locking the rotary locks in their locking positions. One disadvantage in particular is the very complicated construction of this embodiment of a rotary lock, which comprises a plurality of springs and in which locking of the top and bottom transverse latches takes place differently, i.e. with a different mechanism, thus accurately predetermining which transverse latch must first be brought into its locking position.

DE 37 10 419 A1 also discloses a rotary lock for releasably connecting corner fittings of adjacent containers comprising a housing and a locking pin mounted therein having at its two ends opposite transverse latches. In the basic position of the rotary lock, the top transverse latch is in its locked position and the bottom transverse latch in its unlocked position. The connection between the two containers is made as follows: firstly, the top transverse latch is rotated against the force of a tension spring until it fits in the slot of the corner fitting of the top container, and then pushed into the slot. The locking pin is then automatically brought into a prelocking position by partial expansion of the tension spring, this prelocking position corresponding to the basic position. A hand lever, which engages the locking pin, is then actuated against the force of a torsion spring to bring the rotary lock into a locking position so that the top transverse latch engages well beneath the top corner fitting and the bottom transverse latch is not in register with the slot of the corner fitting of the bottom container. When the top container is lowered on to the bottom container, the bottom transverse latch turns against the tension spring prestressing. As soon as the top container has been fully lowered on to the bottom container, the tension spring ensures that the locking position is again reached so that a transverse latch engages beneath a corner fitting. To unlock the rotary lock, the hand lever has to be unlocked manually with the torsion spring again being used. The mechanism of this rotary locking system, which requires at least two springs, is fairly complicated and requires an expensive construction in which again it is exactly predetermined which transverse latch must be locked first.

Also, U.S. Pat. No. 4,782,561, whose disclosure is incorporated by reference thereto and which claims priority from the same Japanese reference as DE 38 09 834 A1, discloses a similar rotary lock. A top transverse latch of the rotary lock is first brought into the top container corner fitting slot after unlocking by means of the hand lever, the latter then being actuated to produce a locking position in which a compression spring is operative to ensure that the top transverse latch engages beneath the corner fitting of the top container. In the next step, the top container is moved towards the bottom container so that the bottom transverse latch can be rotated into the slot of the corner fitting of the bottom container. As soon as the bottom transverse latch has completely rotated into the slot, it returns to its starting position in response to a coil spring, so that each transverse latch engages beneath the associated corner fitting. Unlocking is again obtained by reversing the movement of the hand lever. Again the very complicated structure and expensive mechanism requiring at least two springs are a disadvantage. Once again the locking of the two transverse latches differ from one another so that during locking care must always be taken to see which transverse lock must be locked first.

SUMMARY OF THE INVENTION

The object of the invention therefore is to provide a rotary lock of simple and inexpensive construction and which, in particular, requires only one spring. Another object is to devise the two transverse latches and their connections to the other elements of the rotary lock so that it is immaterial which of the two transverse latches is first locked or unlocked.

To solve this problem, the rotary lock according to the invention is characterized in that only one spring means is required which spring is connected on the one hand to the hand lever and on the other hand to the locking pin, and the housing comprises a locking means or detent means to lock the hand lever and the locking pin in positions corresponding to the three positions of the transverse latches with a basic position housing the two transverse latches in their locking position and any rotation of the locking pin out of this basic position, irrespectively of whether to the left or right, takes place against the force of the spring means which stores energy for a subsequent automatic locking.

Preferably according to the invention, the housing consists of two identical halves secured to one another in a 180° relatively rotated position perpendicularly to a longitudinal axis of the rotary lock, the longitudinal axis being identical to the axis of rotation of the locking pin.

According to the invention, the two transverse latches may be of identical formation, have substantially rectangular sections preferably formed from hexagons with rounded edges, which taper conically away from the shank to form an entry guide surface for the purpose of independent rotation into a slot of a corner fitting of a container, and the latches are so connected to other elements of the rotary lock via the locking pin so that they can be locked and unlocked on the same principle.

One preferred exemplified embodiment of the invention is characterized in that the hand lever and the two transverse latches extend perpendicularly to the axis of rotation of the shank with one transverse latch extending exactly the same amount or angle to the left as the other transverse latch entered to the right with respect to the hand lever. Thus, the hand lever bisects the angle between the two latches.

The invention also proposes that the two transverse latches are disposed at an angle of approximately 46° to 60°, preferably 50° to 56°, relatively to one another about the axis of rotation of the shank.

According to another feature of the invention the housing may comprise a shell or hub surrounding the shank of the locking pin and, in the middle, between the two transverse latches, the housing has a middle part which serves as a spacer means between two stacked containers and comprises the locking or detent means, the hand lever being so disposed relatively to the middle part that it can be engaged with the locking or detent means.

Preferably, according to the invention the pivotable hand lever at least partially traverses the middle part in a passage.

The invention also proposes according to another feature that the hand lever has at one end a handle projecting from the housing, and the other end of the lever is connected to the spring means. The lever has at least one sliding pin which extends from the hand lever parallel to the axis of rotation of the shank between the spring means and the handle and preferably two sliding pins are provided with of which one extends in the direction of one transverse latch and the other in the direction of the other transverse latch.

If required the handle of the hand lever may be formed parallel to the axis of rotation of the shank.

According to another proposal the hand lever comprises means for securing the lever against rotation between the spring means and each sliding pin in order to secure the hand lever against turning inside the middle part.

According to another proposal of the invention the spring means may be a compression spring which at least partially surrounds the hand lever concentrically.

According to the invention, if required, the locking pin has in the region of the middle part of the housing a middle portion having a recess or bore to accommodate part of the hand lever and the compression spring. The bore has a counterbore to form a shoulder which serves to limit the expansion of the compression spring and provides a positive connection between the compression spring and the locking pin.

Alternatively, according to another proposal of the invention, the spring means is a tension spring which is connected non-positively both to one end of the hand lever and to the locking pin.

According to another proposal of the invention the locking pin has in the region of the middle part of the housing a middle portion on which a connecting element is disposed to fix the tension spring.

Preferably, according to the invention, to form the locking or detent means, the middle part is formed, on the side facing the handle of the hand lever, with an edge in a plane with a substantially V-shaped with three locking or detent recesses to accommodate a sliding pin of the hand lever. A first locking or detent recess for securing the basic position of the rotary lock is disposed in the middle between the two limbs of the V-shaped edge. The second locking or detent recess for securing the locking position of just the top transverse latch is disposed in the left-hand limb of the V-shaped edge when viewed from beneath looking towards the middle part, and the third locking or detent recess for securing the locking position of just the bottom transverse latch is disposed in the right-hand limb of the V shape when viewed from beneath looking towards the middle part.

According to another proposal of the invention at the two opposite edges facing the handle and enclosing the hand lever the middle part has a substantially V-shaped edge in a plane extending perpendicular to the shaft with each edge having three aligned locking or detent recesses in such manner that a sliding pin of the hand lever rests on a V-shaped edge and can be brought into a locking recess.

According to another proposal the two limbs of the edge of substantially V-shaped edge are bent perpendicularly to the axis of rotation of the shank, the radius of curvature being positive or negative optionally for each limb.

Preferably, according to the invention, in the basic position of the rotary lock, the hand lever is so disposed as to extend along a plane connecting the two housing halves in the middle of the middle part, contacts a sliding pin in a first locking recess, the top transverse latch extends turned through and angle of 23° to 30°, preferably 25° to 28°, to the left relatively to the connecting plane and the bottom transverse latch correspondingly extends rotated through an angle of 23° to 30°, preferably 25° to 28°, to the right relatively to the connecting plane when viewed from beneath looking at the transverse latches.

Finally, according to the invention, a sliding pin is adapted to slide from the first locking recess along the corresponding V-shaped edge against the force of the spring means in the direction of the second locking recess or in the direction of the third locking recess in such manner that the hand lever is disposed with the end having the handle further away from the axis of rotation of the shank than in the basic position, whereby energy can be stored in the spring means.

The invention is based an the surprising finding that only one spring between a hand lever and a shank of the locking pin in cooperation with at least one sliding pin of the hand lever adapted to slide an a substantially V-shaped edge having three locking recesses is sufficient, after one transverse latch has been rotated, whether the top or bottom latch, into a corner fitting slot on a container, to make available sufficient energy for automatic locking, i.e. turning back, of this transverse latch and ensure locking of the rotary lock, with just one of the two transverse latches or both transverse latches locked.

The rotary lock according to the invention is thus advantageously distinguished by the fact that it has a very simple construction requiring just one spring means. Also, the number of individual parts of the rotary lock and tool costs in production are reduced by the fact that the housing consists of two identical halves.

Handling of the rotary lock according to the invention is greatly improved compared with conventional rotary locks, since the automatic turning back and locking of each of the two transverse latches takes place identically and it is thus immaterial which transverse latch is first locked. Unlocking by means of the hand lever is also equivalent for both transverse latches.

In addition, the rotary lock according to the invention can be used equivalently either as a semi-automatic or as a conventional rotary lock, the term "semiautomatic" meaning that automatic locking takes place when used while unlocking takes place manually. Thus the decision as to how a means of transport: is to be unloaded, i.e. conventionally or by sequence of operations applied when using semi-automatic rotary locks, is independent of the loading method, i.e. conventional or semi-automatic.

Other features and advantages of the invention will be apparent from the following description which explains in detail one exemplified embodiment of the invention with reference to the diagrammatic drawing.

DESCRIPTION OF THE PREFERRED EMBODIMENTS

Figure 1A:
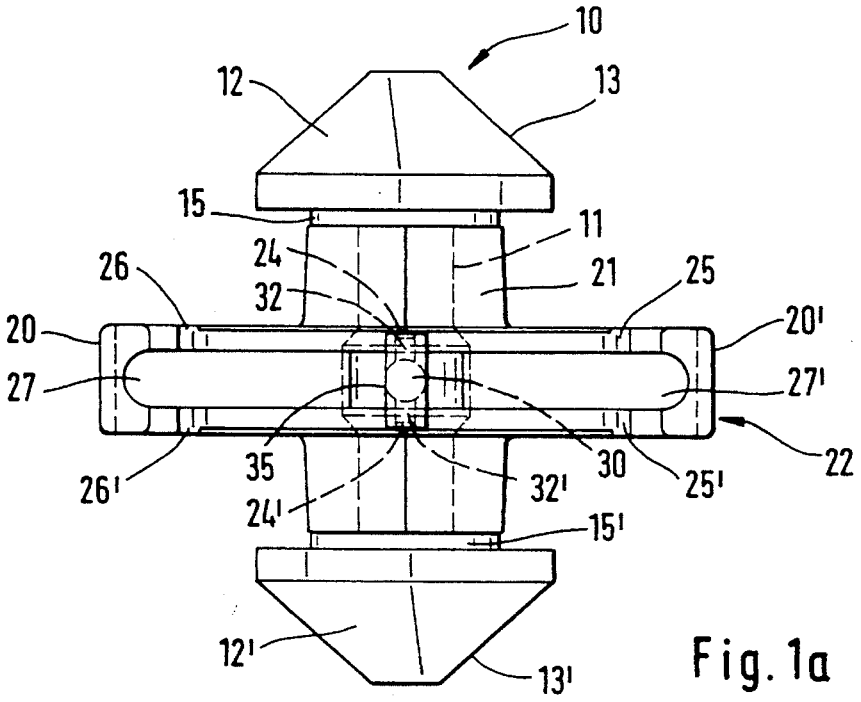
FIG. 1*a* is a side elevational view of a rotary lock according to the invention in its basic position.
Figure 1B:
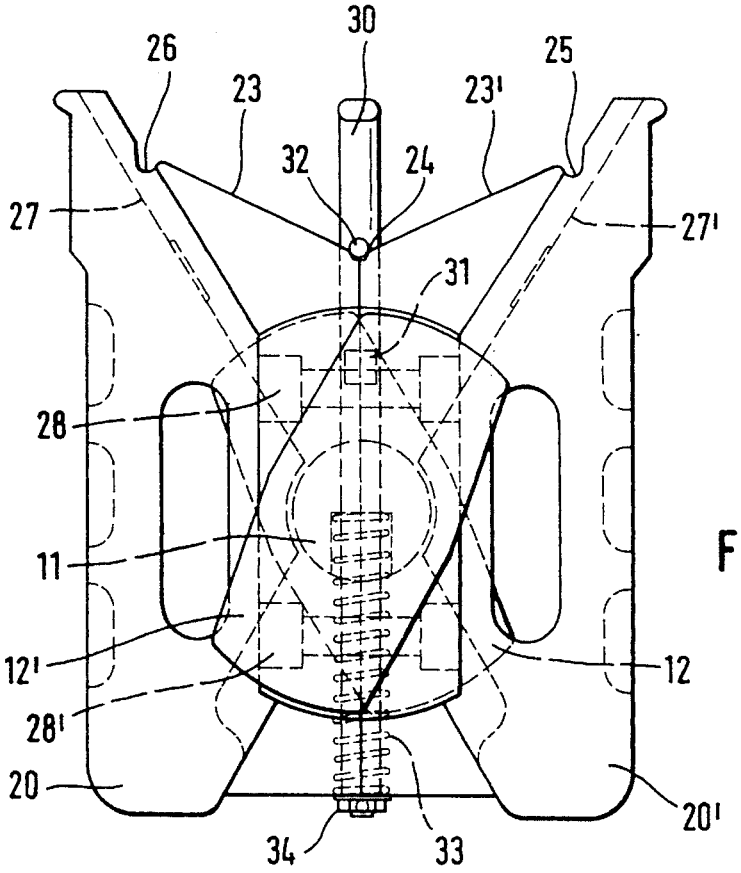
FIG. 1*b* is a bottom plan view of the rotary lock shown in FIG. 1*a*.

As will be apparent from FIGS. 1*a* and 1*b*, the rotary lock according to the invention comprises a locking pin 10 which extends at least partially through a split housing which is formed of housing parts or halves 20, 20' and the pin 10 is connected to a hand lever 30.

Figure 2A:
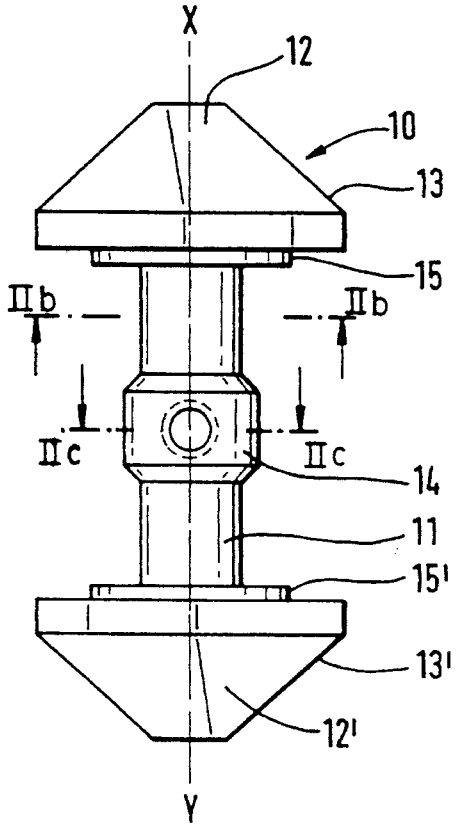
FIG. 2*a* is a side elevational view of just the locking pin of the rotary lock shown in FIG. 1*a*.
Figure 2B:
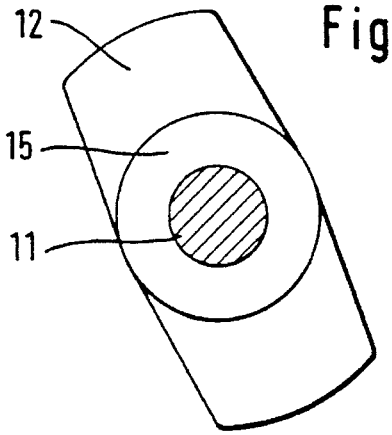
FIG. 2*b* is a cross-sectional view taken along the line IIb—IIb in FIG. 2*a*.
Figure 2C:
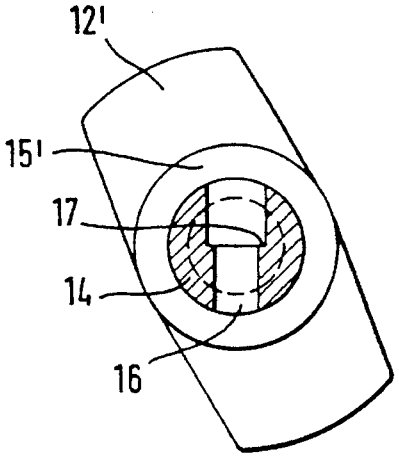
FIG. 2*c* is a cross-sectional view taken along the line IIc—IIc in FIG. 2*a*.
Figure 2D:
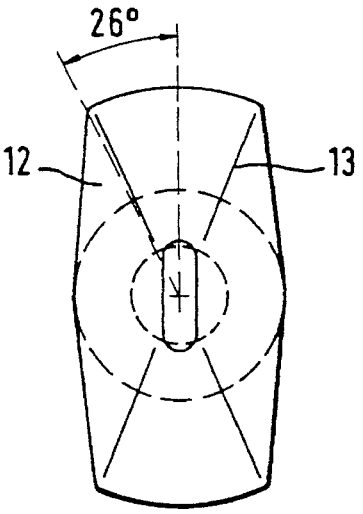
FIG. 2*d* is a plan view of a transverse latch.

As best illustrated in FIG. 2*a*, the locking pin 10 consists of a shank 11, at each end of which is disposed a transverse latch 12, 12' and the center of which consists of a middle portion 14. Discs 15, 15' are provided between the shank 11 and each transverse latch 12, 12' to rest on a housing shell or hub 21, (see FIG. 1*a*). FIGS. 2*b* and 2*c* are each cross-sectional views to illustrate that the shank 11, the middle portion 14 and the discs 15, 15' each have a circular cross-section, while the transverse latches 12, 12' have a substantially rectangular shape or cross section. The substantially rectangular cross-sections consist of hexagons with rounded edges which taper or converge away from the shank 11 to form an entry guide surface 13, 13', see FIGS. 2*a*and 2*d*. It will be apparent from the cross-section shown in FIG. 2*c* that the middle portion 14 has a bore 16 with a counterbore to form a shoulder 17. The bore 16 receives the hand lever 30, as will be described hereinafter.

The shank 11 is mounted for rotation in the housing 20, 20' about an axis shown by the broken line X-Y in FIG. 2*a* with one transverse latch 12 being turned relatively to the other transverse latch 12' through 52° about their axis of rotation. For example, the top transverse latch 12 is turned counterclockwise through 26° and the bottom transverse latch 12 is turned clockwise with respect to the axis of rotation of the shank 11 through 26°, looking from below onto the transverse latches 12, 12' in the basic position.

The housing itself consists of two identical halves or parts 20, 20' which are secured to one another in opposed relationship by means of screws 28, 28'. The housing parts 20, 20' thus formed have the housing shell 21 which surrounds the shank 11 and which in the region of the middle portion 14 has a middle part 22 with a geometric shape which can be seen, for example, from FIG. 1*b*. The middle part 22 has a substantially V-shaped edge in a plane extending perpendicular to the axis X-Y which V-shaped edge is formed by two bevelled edges or limbs 23, 23' of the two housing halves 20, 20'. To enable the hand lever 30 to be pivoted, the hand lever is disposed perpendicularly to the axis of rotation of the shank 11 in the middle part 22 which has passages 27, 27' formed by recesses or grooves in the two housing halves 20, 20' and extending from the edge 23, 23' having the V-shaped shape to the edge opposite the same. The housing halves 20, 20' also have some recesses to reduce the weight, although this is not discussed hereinafter.

The hand lever 30 in turn has means 31 to prevent the lever from being turned, two opposite sliding pins 32, 32' extending parallel to the axis of rotation of the shank 11, and a handle 35 at one end. A compression spring 33 is secured by means of a nut 34 on that end of the hand lever 30 which is remote from the handle 35 and surrounds the hand lever 30 in spiral form and at least partially concentrically. The expansion of the compression spring 33 along the hand lever 30 is limited, on the one hand, by the nut 34 and, on the other hand, by the shoulder 17 in the bore 16, through which the hand lever 30 extends to establish connection with the locking pin 10. Each of the sliding pins 32, 32' can slide along an edge 23, 23' of V-shaped edge of the housing 20, 20' and be inserted in one of the three locking or detent recesses 24, 24', 25, 25', 26, 26' shown. In the basic position of the rotary lock, the hand lever 30 extend parallel to the plane connecting the two housing halves 20, 20' through the middle of the middle part 22 and the passages 27, 27'.

Figure 3B:
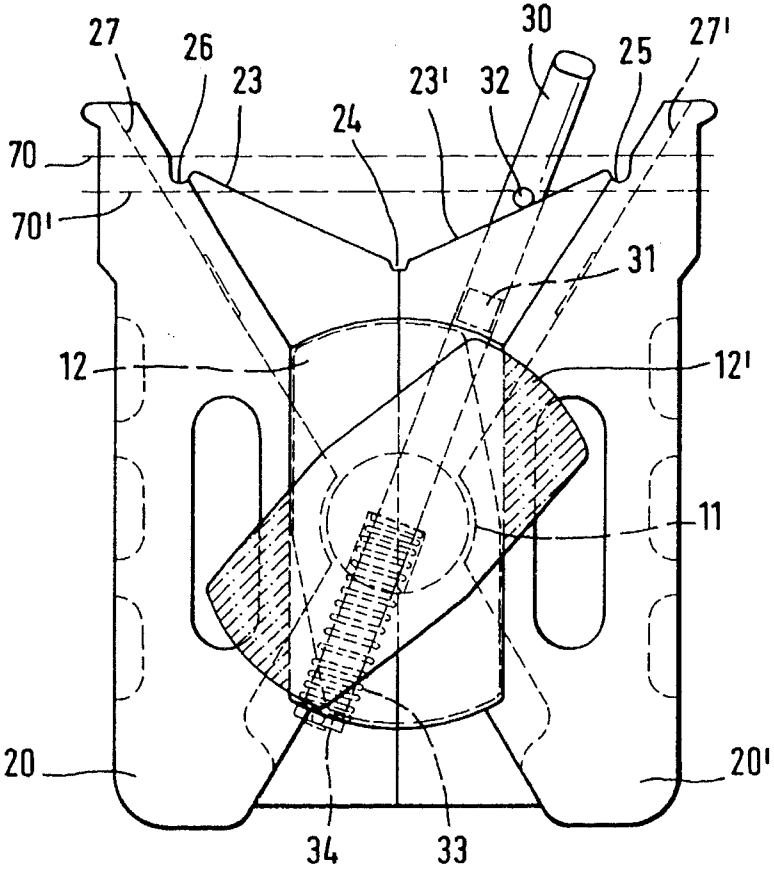
FIG. 3*b* is a bottom view of the rotary lock shown in FIG. 3*a*.
Figure 3A:
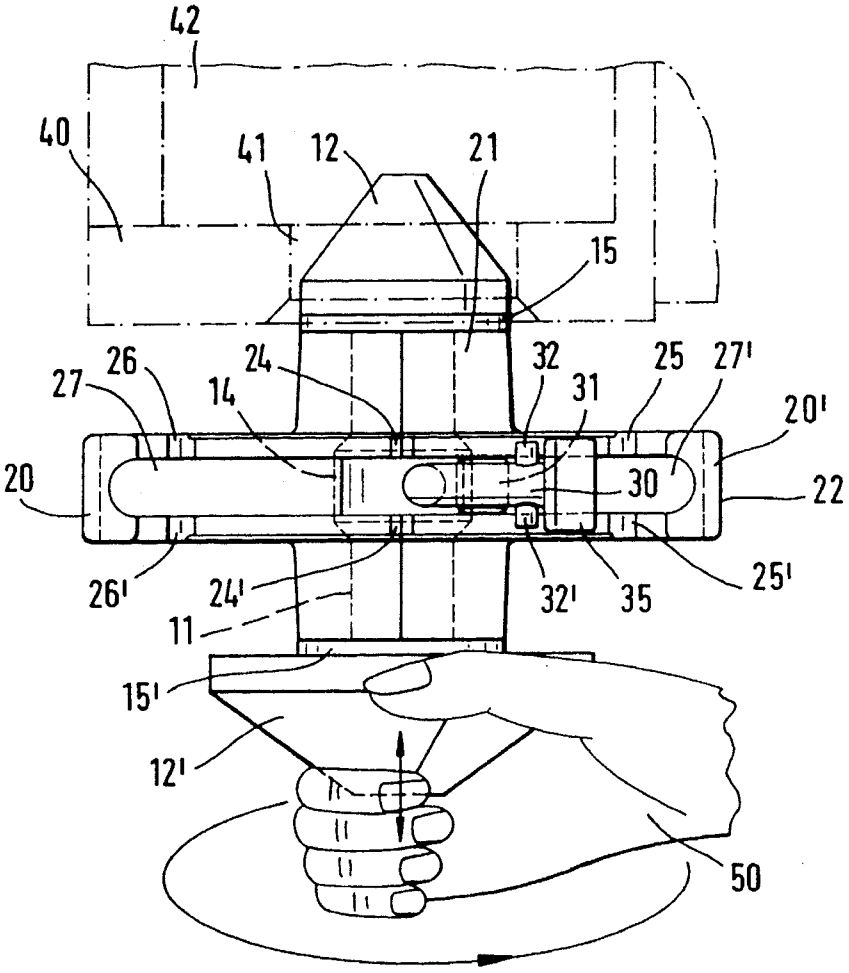
FIG. 3*a* is a side elevation of the rotary lock shown in FIG. 1*a* on insertion of a top transverse latch into the corner fitting (shown in broken lines) of a container.
Figure 5:
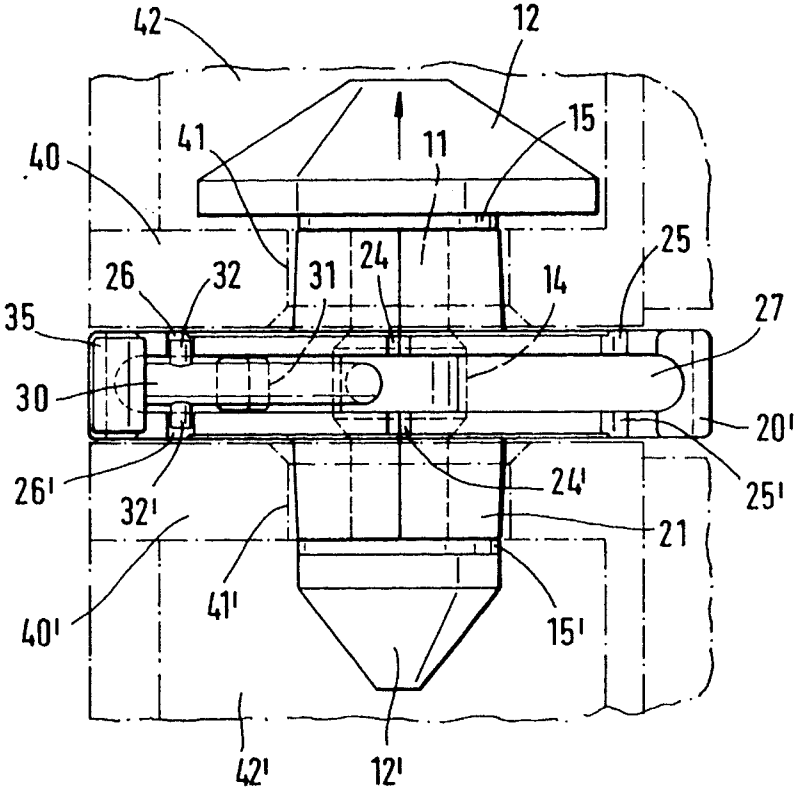
FIG. 5 is a side elevation of the rotary lock of FIG. 4 after unlocking of a bottom latch of the two transverse latches.
Figure 4:
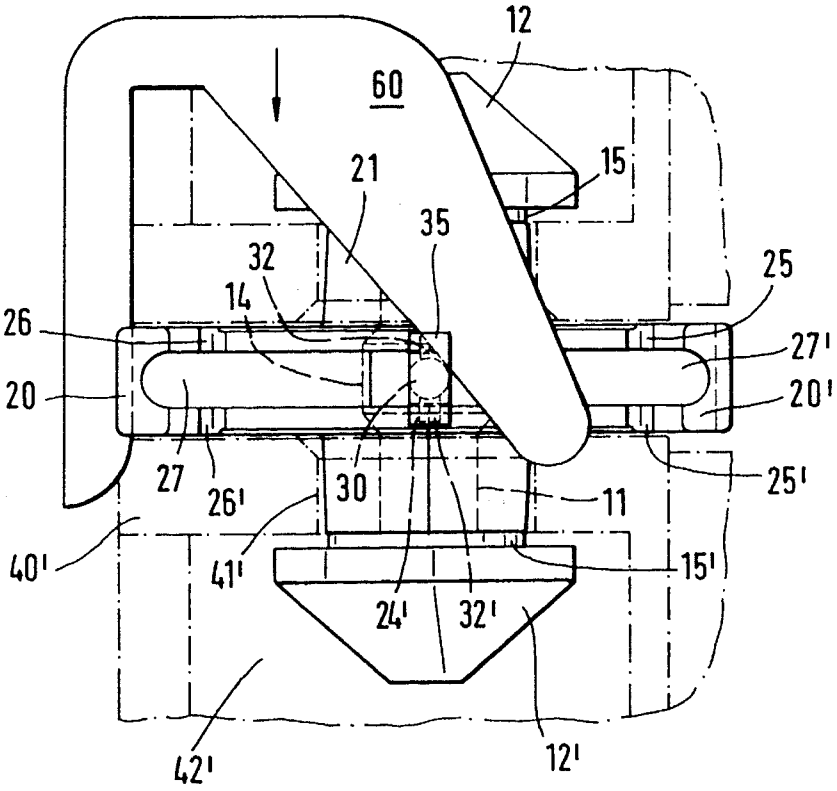
FIG. 4 is a side elevation of a rotary lock according to the invention locked between two container corner fittings (shown in broken lines) and having a pull-open fitting.

The rotary lock according to the invention is used as follows to secure two containers relatively to one another:

Each container has corner fittings 40, 40' each having a slot 41, 41' leading into an interior 42, 42' as will be apparent from FIGS. 3*a*, 4 and 5.

The semi-automatic locking system will first be described:

As shown in FIG. 3*a*, the rotary lock according to the invention is gripped by a hand 50 of a worker at one of the transverse latches 12' and turned in order to rotate the other transverse latch 12 into the slot 41 of the corner fitting 40 of a container. When the other transverse latch 12 is turned into the slot 41, it must be rotated from its locked position, as shown in FIG. 1*a*, into its unlocked position of FIG. 3*a*. In these conditions, the hand lever 30, viewed from beneath, moves to the right out of the basic position to a position shown in FIGS. 3*a* and 3*b*. At the same time, the sliding pins 32, 32' slide from the first locking or detent recesses 24, 24' along the inclined plane of the V-shaped edge 23 upwards to the right, in the direction of the second locking or detent recesses 25, 25'. As a result of the sliding pins 32, 32' moving up along the edge 23, the hand lever 30 moves with the end having the handle 35 away from the axis of rotation of the shank 11, so that the distance between the nut 34 and the shoulder 17 is reduced. This results in the compression spring 33 being compressed and hence energy is stored.

As soon as the other transverse latch 12 has completely passed through the slot 41 and is situated in the interior 42, it automatically turns back to its locking position in response to the force of the compression spring 33, this locking position being identical to the basic position, as shown in FIG. 1*a*. In these conditions, the container edge 70 (maximum), 70' (minimum) (see FIG. 3*b*) is positioned so that the handle 35 is still satisfactorily accessible.

In the next step, one container with the rotary lock is moved towards another container on to which it is to be placed, so that one transverse latch 12' contacts a slot 41' of a corner fitting 40' of this bottom container. As a result of its geometric configuration in the form of a cone or pyramid, the bottom transverse latch 12' now turns automatically into the bottom slot 41' against the force of the compression spring 33. In these conditions, the hand lever 30 is moved, from its position of rest in which the sliding pins 32, 32' rest on the first locking recesses 24, 24' to the left, as considered from beneath, in the direction of the third locking or detent recesses 26, 26'. Again there is a shortening of the distance between the nut 34 and the shoulder 17 and hence a contraction of the compression spring 33. As soon as the bottom transverse latch 12' has entered the interior 42' of the bottom corner fitting 40', it rotates and thus turns the complete locking pin 10, as a result of at least partial expansion of the compression spring 33, back into its locking or basic position as shown in FIG. 4. Each transverse latch 12, 12' now engages beneath a corresponding corner fitting 40, 40' the middle part 22 acting as a spacer means between the two corner fittings 40, 40', i.e. containers.

To unlock the rotary lock thus locked, a pull-open fitting 60 can be so placed around the hand lever 30, i.e. the handle 35, that the hand lever 30 can, with its aid, be moved either to the left, viewed from beneath, to release the locking of the bottom transverse latch 12' or to the right, viewed from beneath, to release the locking of the top transverse latch 12. FIG. 5 shows the situation in which the hand lever 30 has been moved to such an extent to the left, viewed from beneath, until its sliding pins 32, 32' engage in the third locking or detent recesses 26, 26' to secure the bottom transverse latch 12' in the unlocked position. The top container together with the rotary lock can then be driven off so that finally the top transverse latch 12 can be removed by repositioning the hand lever 30.

The conventional securing of containers will now be described:

In this case, the rotary lock is first turned into the corner fitting of the bottom container by one of the two transverse latches 12'. To lock the transverse latch 12' which is thus at the bottom, the hand lever 30 is pushed to the right, viewed from beneath, until its sliding pins 32, 32' engage in the second locking or detent recesses 25, 25'. Thus the bottom transverse latch 12' is in its locked position and the top transverse latch 12 is in its unlocked position.

In the next step, a second container is placed from above on the bottom container and the top transverse latch 12 in its unlocked position is pushed into the corresponding slot of the corner fitting of the upper container. To lock the two transverse latches 12, 12', the hand lever 30 is again brought to its original position, in which the sliding pins 32, 32' engage in the first locking or detent recesses 24, 24'.

For unlocking purposes, the hand lever 30 is again moved to the right viewed from beneath, to an extent such that its two sliding pins 32, 32' pass from the first locking or detent recesses 24, 24' into the second locking or detent recesses 25, 25' and the upper container can again be removed without difficulty.

The rotary lock can be removed from the bottom container if the hand lever 30 is moved to the left, viewed from beneath, until its two sliding pins 32, 32' engage in the third locking or detent recesses 26, 26'.

Other exemplified embodiments operating on the same basic principle as the exemplified embodiments described above with reference to FIGS. 1 to 5 are, of course, possible. For example, the compression spring can be replaced by a tension spring operative correspondingly between the locking pin and the hand lever. Instead of the positive connection between the locking pin and the spring means, a non-positive connection can be used. The connection between table spring means and the hand lever may be either positive or non-positive. Moreover, the edge of substantially V-shaped cross-section can be bent perpendicularly to the axis of rotation of the shank so that the two limbs thereof have either a positive or a negative radius of curvature.

The features of the invention disclosed in the above description, in the drawing, and in the claims, are important both individually and in any combination to embodying the invention in its various forms.

I claim:

1. A rotary lock comprising a locking pin mounted for rotation in a housing on a longitudinal axis of the pin, said pin having a shank with a transverse latch at each end and being connected to a hand lever, the rotary lock being adapted to be brought basically into three positions relatively to the corner fittings of a container for the purpose of releasably connecting two containers one upon the other, said three positions being the locking position of one transverse latch and the unlocking of the other latch, unlocking position of the one transverse latch and the locking of the other transverse latch and a locking position of both transverse latches, the improvement comprising only one spring means being provided and being connected between the hand lever and the locking pin, and the housing having detent means to lock the hand lever and the locking pin in each of the three positions of the transverse latches, the locking position of both transverse latches being a basic position of the rotary lock and any rotation of the locking pin out of the basic position, irrespectively of whether to the left or right, is against the force of the spring means which stores energy for subsequent return to the basic position for automatic locking.

2. A rotary lock according to claim 1, wherein the housing consists of two identical halves secured to one another in a 180° relatively rotated position perpendicularly to a longitudinal axis of the rotary lock which axis is identical to the axis of rotation of the locking pin.

3. A rotary lock according to claim 1, wherein the two transverse latches are of identical formation and have end portions which conically taper away from the shank to form an entry guide surface for the purpose of independent rotation into a slot of a corner fitting of a container, and each latch being connected to other elements of the rotary lock via the locking pin so that the latches can be locked and unlocked on the same principle.

4. A rotary lock according to claim 3, wherein the two transverse latches have rectangular sections.

5. A rotary lock according to claim 4, wherein each rectangular section of each transverse latch is formed from a hexagon with rounded edges.

6. A rotary lock according to claim 1, wherein the hand lever and the transverse latches extend perpendicularly to the axis of rotation of the shank, one transverse latch extending exactly the same angle to the left as the other transverse latch extends to the right with respect to the hand lever.

7. A rotary lock according to claim 1, wherein the two transverse latches are disposed at an angle in a range of 46° to 60°, relatively to one another about the axis of rotation of the shank.

8. A rotary lock according to claim 7, wherein the two transverse latches are disposed at an angle in the range of 50° to 56° relative to one another about the axis of rotation of the shank.

9. A rotary lock according to claim 1, wherein the housing comprises a hub surrounding the shank of the locking pin and in the middle between the two transverse latches, the housing having a middle part which serves as a spacer means between two stacked containers and comprises the detent means, the hand lever being disposed relatively to the middle part so that the hand lever can be engaged with the detent means.

10. A rotary lock according to claim 9, wherein the pivotable hand lever traverses the middle part in a passage thereof.

11. A rotary lock according to claim 1, wherein the hand lever at one end has a handle projecting from the housing, another end of the lever being connected to the spring means, said lever having at least one sliding pin which extends from the hand lever parallel to the axis of rotation of the shank between the spring means and the handle.

12. A rotary lock according to claim 11, which has two sliding pins with one extending in the direction of one transverse latch and the other pin extending in the direction of the other transverse latch.

13. A rotary lock according to claim 11, wherein the handle of the hand lever is formed parallel to the axis of rotation of the shank.

14. A rotary lock according to claim 11, wherein the hand lever comprises means for securing the lever against rotation located between the spring means and the sliding pin in order to secure the lever against turning inside a middle part of the housing.

15. A rotary lock according to claim 11, wherein the spring means is a compression spring which at least partially surrounds the hand lever concentrically.

16. A rotary lock according to claim 15, wherein the locking pin has in a region of a middle part of the housing a middle portion having a bore to accommodate part of the hand lever and the compression spring, said bore having an internal shoulder which serves to limit the expansion of the compression spring and provides a positive connection between the compression spring and the locking pin.

17. A rotary lock according claims 11, wherein the spring means is a tension spring which is connected non-positively both to one end of the hand lever and to the locking pin.

18. A rotary lock according to claim 17, wherein the locking pin has in the region of a middle part of the housing a middle portion on which a connecting element is disposed to fix the tension spring.

19. A rotary lock according to claim 11, wherein to form the detent means, the housing has a middle part with a side facing the handle of the hand lever having an edge of a V-shape which is constituted by two limbs and has three detent recesses to accommodate the sliding pin of the hand lever, a first detent means for securing the basic position of the rotary lock being disposed in the middle between the two limbs of the V-shaped edge, a second detent recess for securing the locking position of the one transverse latch being disposed in a left-hand limb of the two limbs of the V-shaped edge when viewed from beneath looking towards the middle part, and a third detent recess for securing the locking position of the other transverse latch being disposed in a right-hand limb of the two limbs the V-shaped edge when viewed from beneath looking towards the middle part.

20. A rotary lock according to claim 19, wherein the middle part of the housing has two opposite edges facing the handle and enclosing the hand lever, each of said opposite edges having said V-shape and three aligned detent recesses in such a manner that a sliding pin of the hand lever resting on one of said V-shaped edges can be brought into one of the detent recesses.

21. A rotary lock according to claim 19, wherein the two limbs of the edge of the substantially V-shaped edge are curved perpendicularly to the axis of rotation of the shank with a radius of curvature being positive or negative optionally for each limb.

22. A rotary lock according to claim 19, wherein the housing is formed by two housing halves connected in a plane, said basic position of the rotary lock having the hand lever disposed as to extend along the plane connecting the two housing halves in the middle of the middle part with a sliding pin in a first detent recess with the one transverse latch extending at an angle of a range of 23° to 30° to the left relatively to the connecting plane and the other transverse latch correspondingly extends at an angle in a range of 23° to 30° to the right relatively to the connecting plane when viewed from beneath looking at the transverse latches.

23. A rotary lock according to claim 22, wherein said angles range between 25° and 28°.

24. A rotary lock according to claim 22, wherein a sliding pin is adapted to slide from the first detent recess along the corresponding V-shaped edge against the force of the spring means in the direction of the second detent recess or in the direction of the third detent recess in such manner that the hand lever is disposed with the one end having the handle further away from the axis of rotation of the shank than in the basic position, whereby energy can be stored in the spring means.

* * * * *